US007223943B2

(12) United States Patent
Kohlstrung et al.

(10) Patent No.: US 7,223,943 B2
(45) Date of Patent: May 29, 2007

(54) METHOD AND COOKING APPARATUS FOR IMPROVED FRESH AIR SUPPLY

(75) Inventors: Peter Kohlstrung, Kaufering (DE); Thomas Schreiner, Hurlach (DE)

(73) Assignee: Rational AG, Landsberg/Lech (DE)

( * ) Notice: Subject to any disclaimer, the term of this patent is extended or adjusted under 35 U.S.C. 154(b) by 272 days.

(21) Appl. No.: 10/982,513

(22) Filed: Nov. 4, 2004

(65) Prior Publication Data

US 2005/0092313 A1 May 5, 2005

(30) Foreign Application Priority Data

Nov. 4, 2003 (DE) ..... 103 51 476

(51) Int. Cl.
*A21B 1/26* (2006.01)
*A21B 3/04* (2006.01)

(52) U.S. Cl. ..... 219/400; 126/21 A

(58) Field of Classification Search ..... None
See application file for complete search history.

(56) References Cited

U.S. PATENT DOCUMENTS

| | | | | |
|---|---|---|---|---|
| 4,395,233 | A * | 7/1983 | Smith et al. | 219/400 |
| 5,083,505 | A | 1/1992 | Kohlstrung et al. | |
| 5,620,623 | A * | 4/1997 | Baker | 219/400 |
| 6,070,517 | A | 6/2000 | Helm | |
| 6,872,926 | B1 * | 3/2005 | Arntz et al. | 219/400 |
| 6,943,322 | B1 * | 9/2005 | Whipple, Jr. | 219/400 |

FOREIGN PATENT DOCUMENTS

| | | | |
|---|---|---|---|
| DE | 2305025 | A * | 8/1974 |
| DE | 88 14 925.05 | | 3/1989 |
| EP | 0 386 862 | | 2/1990 |
| EP | 0 926 449 | | 12/1997 |
| JP | 08-201367 | A * | 8/1996 |
| WO | WO 90/08924 | | 8/1990 |

* cited by examiner

*Primary Examiner*—Joseph Pelham
(74) *Attorney, Agent, or Firm*—Marshall, Gerstein & Borun LLP

(57) ABSTRACT

In a method for improved fresh air supply in a cooking apparatus, an inner housing is provided to circumscribe a cooking chamber. A fan chamber is separated from the cooking chamber via at least one flow guide element. The fan chamber has a fan with a fan wheel which comprises primary blades on its side facing the first flow guide element and auxiliary blades on its side facing the wall of the inner housing through which the axle of the fan wheel passes to connect with a motor arranged outside of the inner housing. The fan wheel is provided for the circulation of cooking atmosphere and/or suction of fresh air into the inner housing via a fresh air channel, a mouth of which is separated from the axle of the fan wheel and runs into the inner housing through the wall. Fresh air sucked in through the fresh air channel is initially conducted via at least a second flow guide element which prevents a direct impingement of the fresh air on the auxiliary blades and prevents an angular momentum effect by the auxiliary blades from being imparted on the fresh air. The fresh air then is conducted from the axle of the fan wheel into the cooking chamber via the radial guiding or conveying effect of the auxiliary blades.

13 Claims, 4 Drawing Sheets

METHOD AND COOKING APPARATUS FOR IMPROVED FRESH AIR SUPPLY

BACKGROUND

The method and apparatus concerns a method for improved fresh air supply in a cooking apparatus and a cooking apparatus with an inner housing defining a cooking chamber as well as a fan chamber (separated from the cooking chamber via at least one flow guide element) for a fan with a fan wheel impeller which comprises primary blades on its side facing the first flow guide element and auxiliary blades on its side facing the wall (in particular back wall) of the inner housing through which the axle of the fan wheel passes to connect with a motor arranged outside of the inner housing. The fan wheel is provided for the circulation of cooking atmosphere and/or suction (intake) of fresh air into the inner housing via a fresh air channel whose mouth runs into the inner housing through the aforesaid wall of the same separated from the axle of the fan wheel.

Such cooking apparatuses are known in the prior art, see for example European Application 0 386 862 B1. They represent what are known as circulation air cooking apparatuses that allow an at least temporary fresh air supply to adjust desired climate proportions in the cooking chamber. For this purpose, fresh air is typically conveyed from a kitchen atmosphere into a cooking chamber of the cooking apparatus in order to displace portions of a cooking atmosphere, whereby the fresh air fraction of the aforesaid cooking atmosphere is increased while the fraction of other components such as water vapor, carbon dioxide, aromatic compounds and food-specific outgases is reduced. In such circulation cooking apparatuses in which the cooking atmosphere is significantly rotated via primary blades of a fan, a negative pressure for the take-up of fresh air via a fresh air channel is forced using auxiliary blades rotating with the primary blades and lying opposite the same. However, due to the scarce space ratios in a cooking device, it is sometimes not possible to place the mouth of the fresh air channel in the inner chamber (comprising the cooking chamber) of the cooking apparatus in axial proximity to the fan wheel where (in principle) optimal pressure ratios prevail. This has the disadvantage that now no maximum negative pressure is available as a driving force for the intake of the fresh air.

Furthermore, specified in DE 103 39 099.5 (not previously published) by the applicant is a cooking apparatus that ensures an improved fresh air supply in that the, so to speak, blind, mutually rotating air and/or cooking atmosphere is or are directed over at least one constriction on the back side of a fan wheel, thus on the side opposite the primary blades (which side is equipped with auxiliary blades) during each rotation of the fan wheel, such that there a streamline compression occurs. This streamline compression is accompanied with a pressure reduction given nearly isochoric state changes.

SUMMARY

It is an object to further develop the method such that the disadvantages of the prior art are overcome, and thus an improved fresh air supply is present. A design simpler in terms of construction should be provided that also enables a retrofitting of flow circulation cooking apparatuses.

A method is provided for improved fresh air supply in a cooking apparatus. An inner housing circumscribes a cooking chamber as well as a fan chamber. The fan chamber is separated from the cooking chamber via at least a first flow guide element. The fan chamber has a fan with a fan wheel comprising primary blades on its side facing the first flow guide element and auxiliary blades on its side facing a wall of the inner housing through which an axle of the fan passes. The fan wheel provides at least one of circulation of cooking atmosphere and suction of fresh air to the inner housing via a fresh air channel, a mouth of which runs into the inner housing through the inner housing wall separated from the axle of the fan wheel. Fresh air is sucked in through the fresh air channel via at least a second flow guide element, which prevents a direct impingement of the fresh air on the auxiliary blades and/or prevents an angular momentum caused by the auxiliary blades from being impressed onto the fresh air. The fresh air is then guided from the axle of the fan wheel into the cooking chamber via a radial guide effect of the auxiliary blades.

DESCRIPTION OF THE PREFERRED EMBODIMENTS

Figure 1:
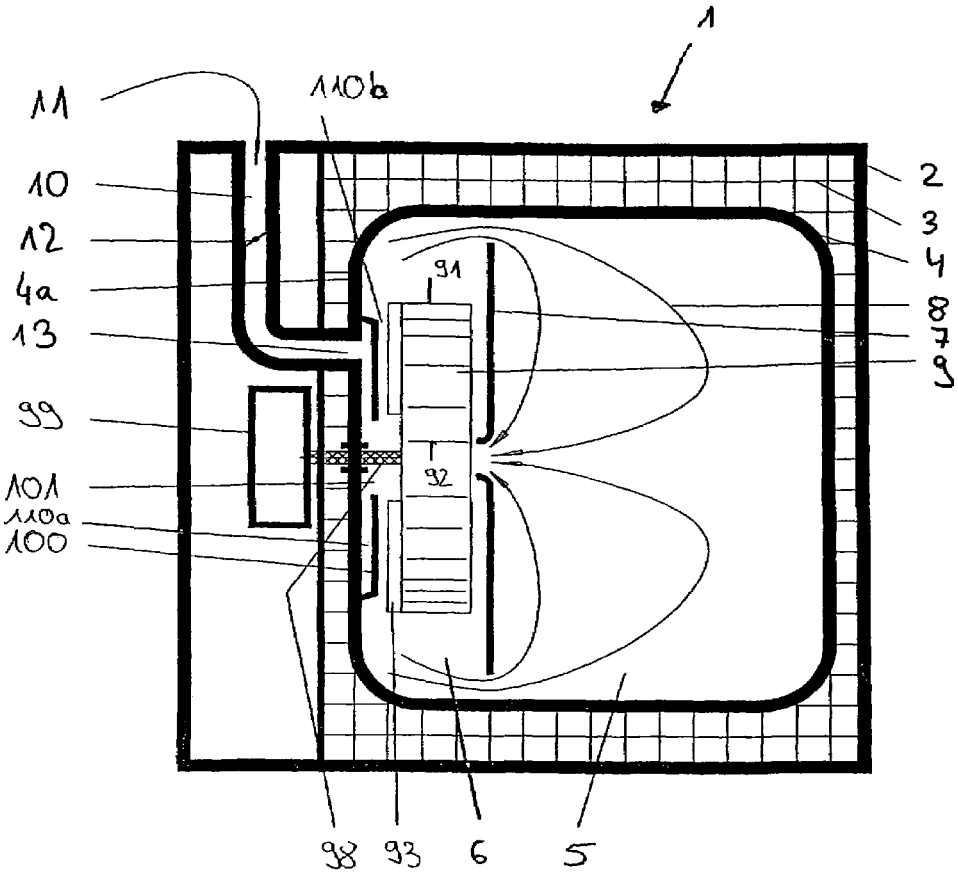
FIG. 1 is a sectional view through a cooking apparatus with fresh air supply in a first embodiment.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated devices, and/or methods, and such further applications of the principles of the invention as illustrated therein being contemplated as would normally occur now or in the future to one skilled in the art to which the invention relates.

With the disclosed method of the preferred embodiment, fresh air sucked in through the fresh air channel is initially conducted via at least a second flow guide element preventing a direct impingement on the auxiliary blades while allowing a rotary guiding effect by the auxiliary blades near the axle of the fan wheel. The air is then guided or conducted from the axle of the fan wheel into the cooking chamber via the radial conduction effect of the auxiliary blades.

Thus a rotation of the fresh air in the region between the second current conductor element and the aforesaid wall is significantly prevented via the use of at least one third flow guide element.

It is also provided that the current resistance for the fresh air upon entrance of the fresh air from the fresh air channel into the inner housing in the region between the aforesaid wall and the second flow guide element is reduced in that the cross-section of the mouth of the fresh air channel is selected larger than the cross-section of the fresh air channel.

The cooking apparatuses of the preferred embodiments are characterized by at least a second flow guide conductor element that partitions the region between the wall and the auxiliary blades into two intervening spaces at least in the region of the mouth of the fresh air channel, and leaves open the region of the axle of the fan wheel, whereby fresh air can be guided or conducted from the fresh air channel via a first intervening space, significantly without eddies near the axle, and from the area of the axle into the cooking chamber via the second intervening space via auxiliary blades.

It can thereby be provided that the second flow guide element significantly extends over the running area of the auxiliary blades and exhibits an opening for the passage of the axle of the fan wheel.

It is also provided with the preferred embodiment that the second flow guide element is aligned towards the axle of the fan wheel, in particular runs essentially perpendicular to the same, are preferably rotationally symmetrical to the same.

Preferred embodiments of the cooking chamber can be characterized by at least a third flow guide element between the second flow guide element and the aforesaid wall to prevent a rotation of the fresh air in the first intervening space, whereby the third flow guide element preferably stands essentially perpendicular to the second flow guide element and/or the aforementioned wall.

A plurality of third flow guide elements can thereby be provided, whereby preferably each third flow guide element spreads outwards radially from the axle of the fan wheel.

It also may be provided that the cross-section of the mouth of the fresh air channel is larger than the cross-section of the fresh air channel, whereby the cross-section of the mouth is preferably adjustable via at least one adjustment element.

It can be provided that a sealing element is arranged in the fresh air channel, preferably in the form of an adjustable diaphragm or flap.

Embodiments are also provided that are characterized by at least one sensor to detect at least one climate parameter.

Furthermore, it can be provided that a first, second and/or third flow guide element is or are movable, in particular portable, deployable, guidable, rotatable, and/or pivotable.

Finally, with preferred embodiments, by a control and/or regulation device in effective connection with the fan (in particular the motor of the fan wheel), the first flow guide element, the second flow guide element, the third flow guide element, the adjustment element, the sealing element and/or the sensor may be provided.

The preferred embodiment is based on the surprising realization that a supply of non-rotating fresh air in the region between the wall of an inner housing of a cooking device, in particular the back wall of the inner housing, and a fan wheel in the inner housing in direct proximity to the axle of the fan wheel itself, is possible when the mouth of a fresh air channel in the inner housing is spaced away from the aforesaid axle in order to use the entire length of auxiliary blades (that are provided on the side of the fan wheel facing towards the back wall) to convey the fresh air into the cooking chamber. For this purpose, the region between the auxiliary blades and the back wall is divided (via a flow guide element that acts as a partition wall) into two intervening spaces that are only connected with one another via an opening in the aforesaid flow guide element near the axle of the fan wheel. Fresh air drawn in via the fresh air channel can thus arrive in the region between the back wall and the flow guide element (first intervening space) in order to then flow via the opening of the flow guide element into the region between the current conductor element and the auxiliary blades (second intervening space), the fresh air arriving into the cooking atmosphere and finally into the cooking chamber via the conveying effect of the auxiliary blades. Nearly the same pressure ratios that would be present in the case in which the mouth of a fresh air channel were to lie in immediate proximity of the axle of the fan wheel are thus realized in the fresh air supply with a separation from the axle of the fan wheel.

In the structural embodiment of the mouth of the fresh air channel, both corresponding to the fresh air channel and the back wall of the inner housing, substantially no eddies should form between the flow guide element and the back wall that, due to their rotation, would oppose an inhibitive pressure of the fresh air supply in the first intervening space. On the one hand, in the arrangement of the partition wall-like flow guide element, care must be taken that the supplied fresh air is not accelerated in the first intervening space. Thus a minimum distance between the back wall and the aforesaid flow guide element is maintained. On the other hand, the flow guide element is to be separated from the auxiliary blades such that the drawn-in fresh air in the second intervening space is set in rotation to a degree that sets a desired flow volume.

As is to be learned from FIG. 1, a cooking apparatus which acts as a circulation air cooking apparatus comprises an outer housing 2 in which is arranged upon interposition of an insulation 3 an inner housing 4 which, among other things, comprises a back wall 4*a*. A cooking chamber 5 and a fan chamber 6 that are separated from one another via a first flow guide element 7 are in turn provided within the inner housing 4. Cooking atmosphere 8 can be circulated in the inner housing 4 via a fan 9, while fresh air 11 can be introduced into the inner housing 4 via a fresh air channel 10 given an open flap 12 in the region of a mouth 13. For this purpose, the fan 9 comprises a fan wheel 91 with primary blades (see primary blade edges 92) on its side facing the first current conductor element 7, and thus the cooking chamber 5, and auxiliary blades (see auxiliary blade edges 93) on its side facing away from the cooking chamber 5 and thus facing the back wall 4*a*. The fan wheel 91 can be driven by a motor 99 via an axle 98.

If, given an open flap 12, fresh air 11 is drawn in via the fresh air channel 10 through the mouth 13 into the region between the back wall 4*a* and the auxiliary blades 93 (separated by the axle 98), a second flow guide element 100 provides that the fresh air 11 does not directly impinge on the auxiliary blades 93, but rather initially is guided or conveyed within a first intervening space 110*a* into the proximity of the axle 98 in order to there be conveyed into the cooking chamber 5 via the conveying force of the auxiliary blades 93 via passage of a second intervening space 110*b*. Both intervening spaces 110*a*, 110*b* are thus provided via the inter-arrangement of the flow guide element 100 between the back wall 4*b* and the auxiliary blades 93, whereby a connection of both intervening spaces 110*a* and 110*b* is ensured by an opening 101 in the second flow guide element 100 in the region of the axle 98.

Figure 2:
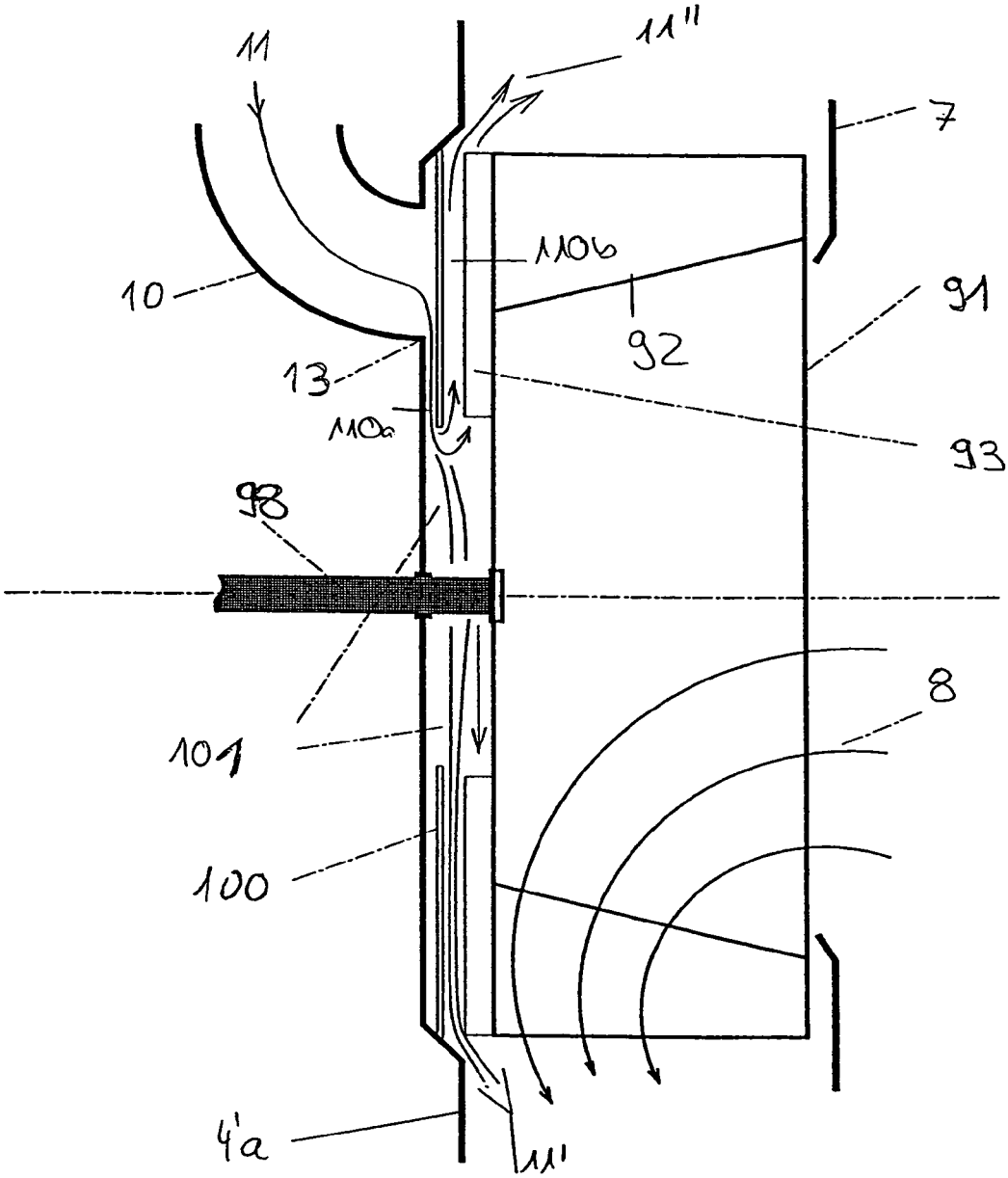
FIG. 2 is a sectional view through a cooking apparatus with fresh air supply in a second embodiment.

The path of the flow of the fresh air 11, 11', 11" via use of the second flow guide element 100 is shown in FIG. 2. According to that Figure, the fresh air 11 is guided or conveyed (substantially without eddies) through the fresh air channel 10 and into the first intervening space 110*a*, while in the region of the opening 101 of the second flow guide element 100 there is a rotary effect caused by the auxiliary blades 93, so that the fresh air then placed into rotation for transport into the cooking chamber flows through the second intervening space 110*b*, into the cooking chamber as shown at 11".

It can be learned from FIG. 2 that the back wall 4*a* runs displaced outwardly in the region of the fan wheel 91 to enlarge the intervening spaces 110*a*, 110*b* between the auxiliary blades 93 and the back wall 4*a*.

Figure 3:
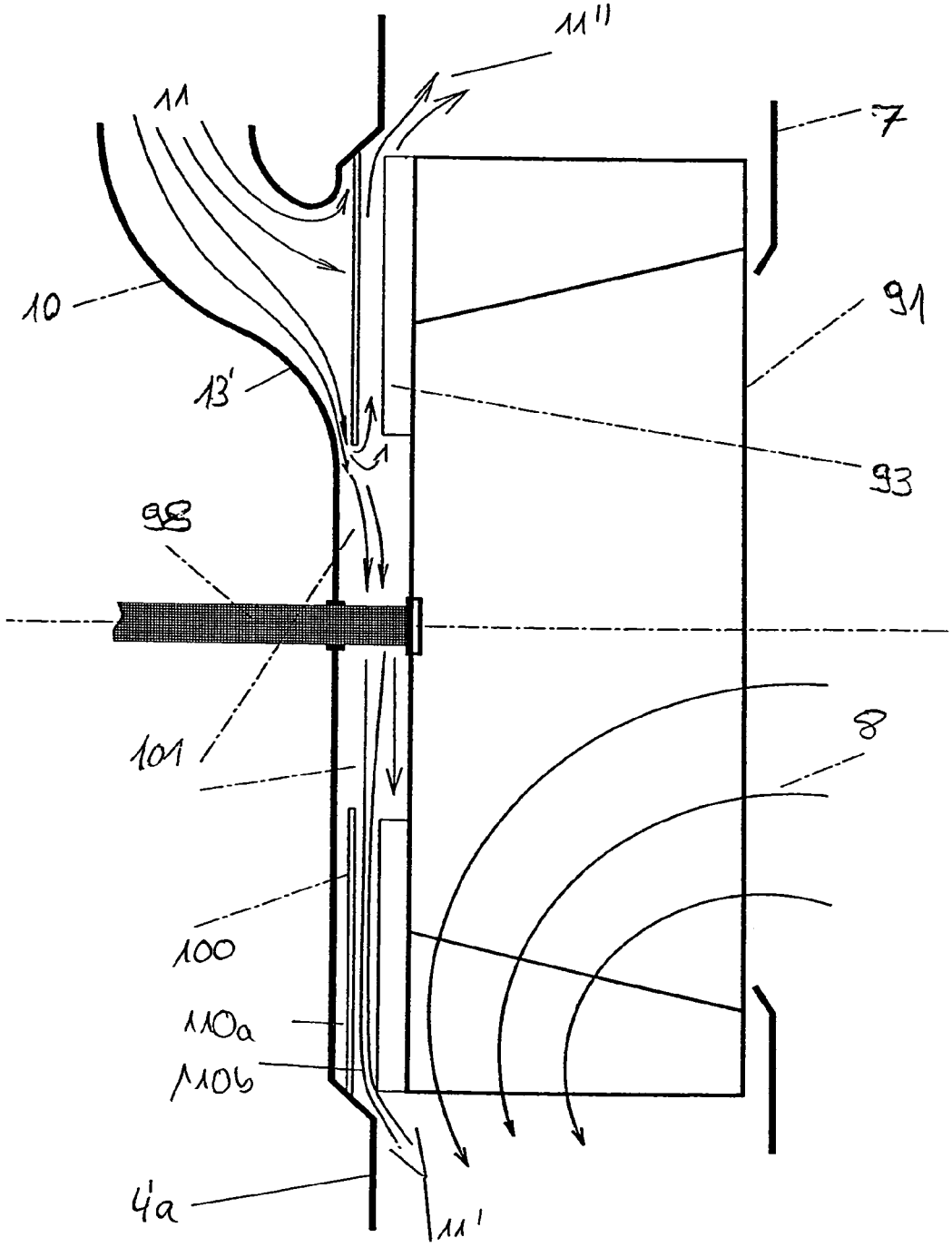
FIG. 3 is a sectional view through a cooking apparatus with fresh air supply in a third embodiment.

The cooking apparatus of FIG. 3 differs from that of FIG. 2 inasmuch as the mouth 13' of the fresh air channel 10 in the inner housing 4 exhibits a cross-section that is larger than the cross-section of the fresh air channel 10 itself. This provides for a reduction of the current resistance of the fresh air 11 upon entrance of the same into the first intervening space 110*a*.

Figure 4:
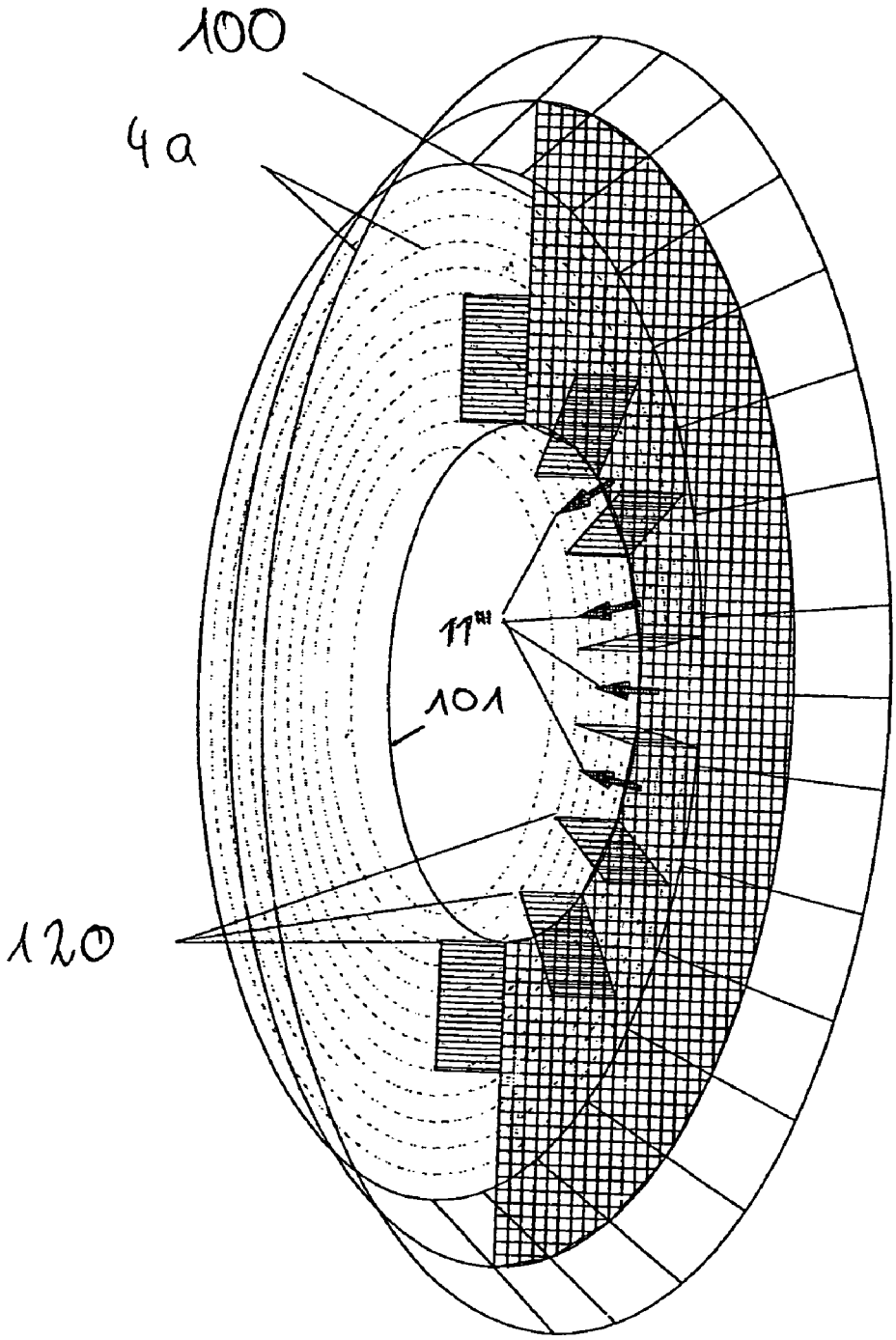
FIG. 4 is a perspective plan view of the back wall of a cooking apparatus showing second and third glow guide elements.

In FIG. 4, a cooking apparatus is shown that, to further prevent a rotation of the fresh air 11 in the first intervening space 110*a*, comprises third flow guide elements 120 in the form of a plurality of ribs radially extending away from the axle 98 of the fan wheel 91. The flow of the fresh air 11''' runs between the ribs towards the axle 98 substantially without eddies.

While preferred embodiments have been illustrated and described in detail in the drawings and foregoing description, the same is to be considered as illustrative and not restrictive in character, it being understood that only the preferred embodiments have been shown and described and that all changes and modifications that come within the spirit of the invention both now or in the future are desired to be protected.

We claim as our invention:

1. A method for improved fresh air supply in a cooking apparatus, comprising the steps of:

providing a housing to circumscribe a cooking chamber as well as a fan chamber, the fan chamber being separated from the cooking chamber via at least a first flow guide element, the fan chamber having a fan with a fan wheel which comprises primary blades on its side facing the first flow guide element and auxiliary blades on its side facing a wall of the housing through which an axle of the fan wheel passes;

providing said fan wheel for circulation of cooking atmosphere and suction of fresh air into the housing via a fresh air channel whose mouth runs into the housing through said housing wall separated from the axle of the fan wheel;

guiding fresh air, sucked in through the fresh air channel, near the axle of the fan wheel by at least one second flow guide element which prevents a direct impingement of the fresh air on the auxiliary blades and prevents an angular momentum caused by the auxiliary blades from being impressed onto the fresh air; and guiding the fresh air from the axle of the fan wheel into the cooking chamber by a radial conveying effect of the auxiliary blades.

2. A method according to claim 1 wherein a rotation of the fresh air in a region between the second flow guide element and said wall is significantly prevented via use of at least one third flow guide element.

3. A method according to claim 1 wherein a flow resistance for the fresh air is reduced upon entrance of the fresh air from the fresh air channel into the inner housing in the region between said wall and the second flow guide element such that a cross-section of the mouth of the fresh air channel is selected larger than a cross-section of the fresh air channel.

4. A cooking apparatus, comprising:

a housing to circumscribe a cooking chamber as well as a fan chamber for a fan, the fan chamber being separated from the cooking chamber via at least one flow guide element;

the fan comprising fan wheel which comprises primary blades on its side facing a first flow guide element and auxiliary blades on its side facing a wall of a housing through which an axle of the fan wheel passes.

said fan wheel being designed for circulation of cooking atmosphere and suction of fresh air into the inner housing via a fresh air channel, a mouth of the channel being separated from the fan wheel axle which runs into the housing through said wall; and at least one second flow guide element that partitions a region between the wall and the auxiliary blades into first and second intervening spaces at least in a region of the mouth of the fresh air channel, and leaves open a region of the axle of the fan wheel so that fresh air is guided from the fresh air channel via a first intervening space substantially without eddies to a region near the axle, and from the region near the axle into the cooking chamber via the second intervening space via said auxiliary blades.

5. A cooking apparatus according to claim 4 wherein the second flow guide element substantially extends over a movement region of the auxiliary blades and exhibits an opening for passage of the axle of the fan wheel.

6. A cooking apparatus to claim 4 wherein the second flow guide element is aligned towards the axle of the fan wheel, is running substantially perpendicular to the axle, and is rotatably symmetrical to the axle.

7. A cooking apparatus according to claim 4 wherein at least a third flow guide element is provided between the second flow guide element and said wall to prevent a rotation of the fresh air in the first intervening space, the third flow guide element being substantially perpendicular to at least one of the second flow guide element and said wall.

8. A cooking apparatus according to claim 7 wherein a plurality of third flow guide elements are provided, each third flow guide element extending radially outwardly from the axle of the fan wheel.

9. A cooking apparatus according to claim 4 wherein a cross-section of the mouth of the fresh air channel is larger than a cross-section of the fresh air channel, the cross-section of the mouth being adjustable by at least one adjustment element.

10. A cooking apparatus according to claim 4 wherein a sealing element is provided in the fresh air channel which is in a form of at least one of an adjustable diaphragm and an adjustable flap.

11. A cooking apparatus according to claim 4 wherein at least one sensor is provided to detect at least one climate parameter.

12. A cooking apparatus according to claim 4 wherein at least one of the first, second, and third flow guide element is at least one of movable, portable, collidable, deployable, rotatable, and pivotable.

13. A cooking apparatus according to claim 4 wherein at least one of a control and a regulation device is in effective connection with at least one of the first flow guide element, the motor of the fan wheel, the second flow guide element, a third flow guide element, an adjustment element, a sealing element, and a sensor.

* * * * *